US005276929A

United States Patent [19]

Mitchell

[11] Patent Number: 5,276,929

[45] Date of Patent: * Jan. 11, 1994

[54] SCREW GUN ROUTER FOR DRYWALL INSTALLATION

[76] Inventor: Brent R. Mitchell, 2669 E. Cantebury La., Salt Lake City, Utah 84121

[ * ] Notice: The portion of the term of this patent subsequent to Nov. 16, 2010 has been disclaimed.

[21] Appl. No.: 877,211

[22] Filed: May 1, 1992

[51] Int. Cl.[5] ..... B26B 11/00

[52] U.S. Cl. ..... 7/158; 173/50; 7/165; 81/177.2

[58] Field of Search ..... 7/158, 165, 167; 81/54, 81/57.14, 57.22, 57.31, 57.36, 177.1, 177.2, 180.1; 173/48, 50; 408/20

[56] References Cited

U.S. PATENT DOCUMENTS

| | | | |
|---|---|---|---|
| 2,963,913 | 12/1960 | Wensloff | 173/50 X |
| 3,351,111 | 11/1967 | Biddle | 81/177.2 X |
| 3,783,955 | 1/1974 | Gill | 81/57.22 X |
| 4,833,746 | 5/1989 | Yong | 7/158 X |
| 4,976,173 | 12/1990 | Yang | 7/158 X |
| 5,056,387 | 10/1991 | Cook | 81/177.2 X |
| 5,123,309 | 6/1992 | Moceri | 81/177.2 X |
| 5,149,230 | 9/1992 | Nett | 7/165 X |

*Primary Examiner*—James G. Smith
*Attorney, Agent, or Firm*—Terry M. Crellin

[57] ABSTRACT

An improvement is provided in a screw gun used in the drywall installation industry. The improved screw gun has a conventional screw driving head at the forward end of the gun. A rear drive shaft extends from the motor of the gun, and an access member is provided at the back of the screw gun to provide access to the distal end of the drive shaft. An adapter member is adapted to be received in and withdrawn from the access member. The adapter member has a rotatable cutting tool associated therewith. Rotational motion is transmitted from the drive shaft to the rotatable cutting tool by the adapter member when the adapter member is received in the access member and the rear drive shaft is driven by the motor.

8 Claims, 2 Drawing Sheets

SCREW GUN ROUTER FOR DRYWALL INSTALLATION

BACKGROUND OF THE INVENTION

1. Field of the Invention

The present invention relates to an adapter device which can be inserted into an access opening in the rearward, handle portion of a screw gun which has been provided with means for accepting the adapter device. The screw gun is otherwise conventional having a spring biased clutch at its forward drive end that must be engaged before the screw gun will transmit rotational motion from its motor to its forward, output drive member. The present invention allows an adapter to engage the drive shaft of the motor from the rearward handle end of the screw gun to provide a rotatable cutting or drilling tool at the rearward handle end of the screw gun in a quick and easy manner thereby eliminating the need for a separate drill or cutting tool.

2. State of the Art

Conventional power tools as used in the drywall industry typically perform only one function. For example, a screw gun is used for inserting screw type fasteners or attachments through the sheets of drywall, and a separate, distinct router is used to cut openings in the drywall panels after they have been attached to their stud supports. Typical screw gun devices are shown in U.S. Pat. Nos. 2,857,997, 2,950,626, 4,159,050 and 4,804,048. Such tools allow the drive member to slip when a desired tightening torque has been attained in the screw type fasteners or attachments being driven through the drywall panels. However, such screw gun tools do not eliminate the need for the operator to carry a router tool in addition to the screw gun.

Generally, heretofore an installer of drywall typically employed a screw gun for securing the drywall to the framework along with a drywall cutout tool or router which is specifically designed for making cutouts in the drywall for electrical boxes, window openings, splices, etc. In U.S. Pat. No. 5,090,545 a modification of a conventional screw gun is disclosed in which a nose cone adapter is fit on the nose cone of the screw gun so that the screw gun can function both as a drive tool and as a drywall cutout device. Unfortunately, to fit on the nose cone of a conventional screw gun, the adapter must be of a size that is awkward in actual use. In addition complex mechanisms are required for activating and transmitting proper speed of rotation to the drive tool. The adapter tool of U.S. Pat. No. 5,090,545 is relatively expensive and cumbersome to use.

3. Objectives

A principal objective of the present invention is to provide a simplified, relatively small, inexpensive adapter for a screw gun which is attachable to the back side of the handle of the screw gun for readily converting the screw gun into a router or cutting member and back to a screw gun by merely attaching and removing the adapter in an access provided at the back side of the handle of the screw gun.

A further object of the present invention is to provide an adapter for the back side of a screw gun which is relatively simple to manufacture, install and operate.

BRIEF DESCRIPTION OF THE INVENTION

The above objectives are achieved in accordance with the present invention by providing a novel adapter for and modification to a screw gun for quickly and easily converting the screw gun into a router or cutting tool useful during installation of drywall panels.

The present invention comprises an improvement in an otherwise conventional screw gun having a forward end, a handle and a backward end, with a drive motor positioned within the screw gun between the forward end and the backward end thereof. Such a screw gun further includes a driving head that is mounted at the forward end of the screw gun to be driven by the motor.

The improvement of the present invention comprises an access opening which is provided through the backward end of the screw gun, with the access opening being in alignment with the rotational axis of the drive motor. An engageable end portion of a rear drive shaft extends from the drive motor and is accessible through the access opening.

A removable drive member is provided which is capable of engagement with the access opening by manually grasping the housing of the removable drive member and inserting the end of the housing into the access opening. An elongate, rotatable, extension shaft extends longitudinally through the housing of the removable drive member for free rotation about a longitudinal axis of the extension shaft.

A first end of the extension shaft is accessible at the end of the housing that is inserted into the access opening of the screw gun. The other end of the extension shaft is accessible at the end of the housing projecting from the screw gun when the removable drive member is engaged in the access opening of the screw gun.

Means are provided for engaging the first end of the extension shaft to an end portion of the rear drive shaft of the screw gun when the removable drive member is manually inserted in the access opening of the screw gun. The other end of the extension shaft is provided with means for mounting a rotatable tool to that end of the extension shaft.

When the adapter of the present invention is attached to the screw gun, the user of the screw gun can turn the gun around such that the back end of the gun is directed forwardly. The router tool on the adapter can then be used to cut openings in the drywall panels. The screw gun is easily and quickly converted back to its conventional use by removing the adapter from the screw gun and turning the screw gun back so that the screw driving head faces forwardly.

In a slightly modified embodiment of an improved screw gun in accordance with the present invention, a rear drive shaft extends from the drive motor of the otherwise conventional screw gun. An access means is provided at the backward end of the screw gun, with the access means being in axial alignment with the rear drive shaft of the motor. An end portion of the rear drive shaft is accessible by way of the access means, and a removable attachment member is manually engaged with and disengaged from the access means.

A rotatable drive member is associated with the attachment member, and means are provided for coupling the rotatable drive member to the end portion of the rear drive shaft of the drive motor when the removable attachment member is engaged with the access means. Means are further provided for mounting a rotating tool to the rotatable drive member so that when the removable attachment member is engaged with the access means, the rotating tool extends away from the backward end of the screw gun and rotates with the rotatable drive member.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
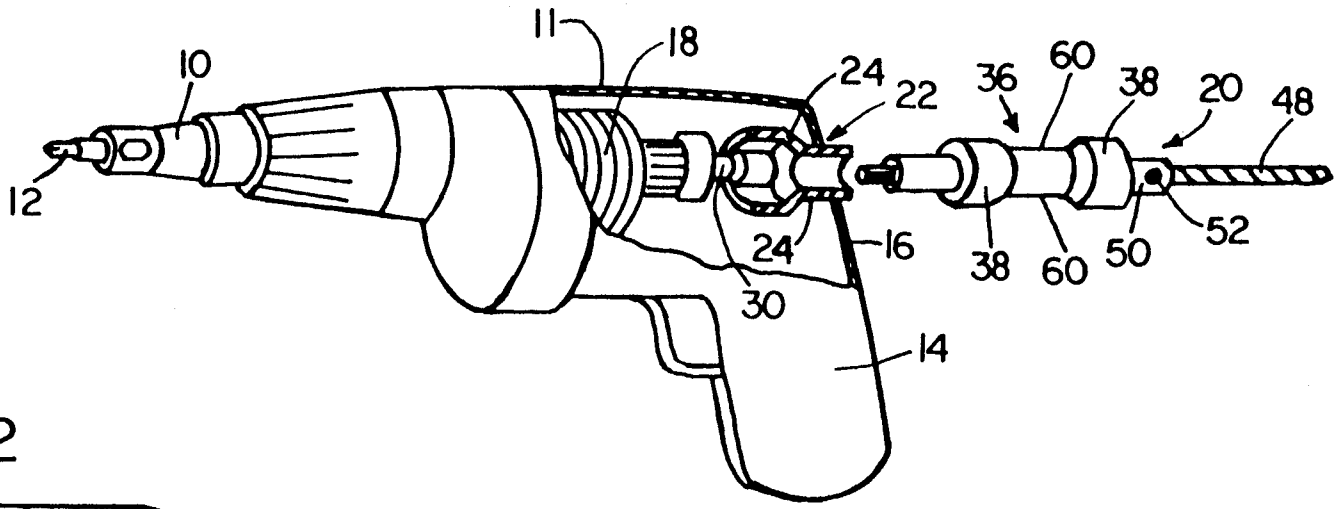
FIG. 1 is a pictorial representation of an improved screw gun in accordance with the present invention, with a portion of the housing of the screw gun being broken away to show the improvements of the present invention.

The present invention pertains to novel improvements to an otherwise conventional screw gun as used in the drywall industry. Screw guns are used extensively by those installing drywall panels. Such screw guns have a forward end 10 comprising a nosepiece or screw driving head including a driving bit 12 that is adapted to release a driven screw type fastener when the screw type fastener is inserted to a proper depth in a drywall panel. The conventional screw gun also includes a housing having a handle 14 and a backward end 16 adjacent to the handle 14. Further, a drive motor 18 is positioned within the screw gun between the forward end and the backward end. The driving bit 12 is driven by the motor 18 as is well known in the art.

The improvement of the present invention relates to an easily used adapter 20 that can be coupled to the drive motor 18 through the backward end 16 of the screw gun to quickly convert the screw gun into a router or cutting tool that can be used by the drywall installer to cut openings such as for electrical outlets into the installed drywall panels. As mentioned previously, it has been customary for the drywall installer to carry two tools, i.e., a screw gun and a router or cutting tool. The screw gun is used in driving screw type fasteners into the drywall panel as the panel is installed on the stud supports. The router or cutting tool is used to cut openings in the drywall panel. Customarily, the installer is continuously unplugging one tool and plugging in the other tool to an electrical cord. This changing back and forth between tools wastes a considerable amount of time.

Figure 2:
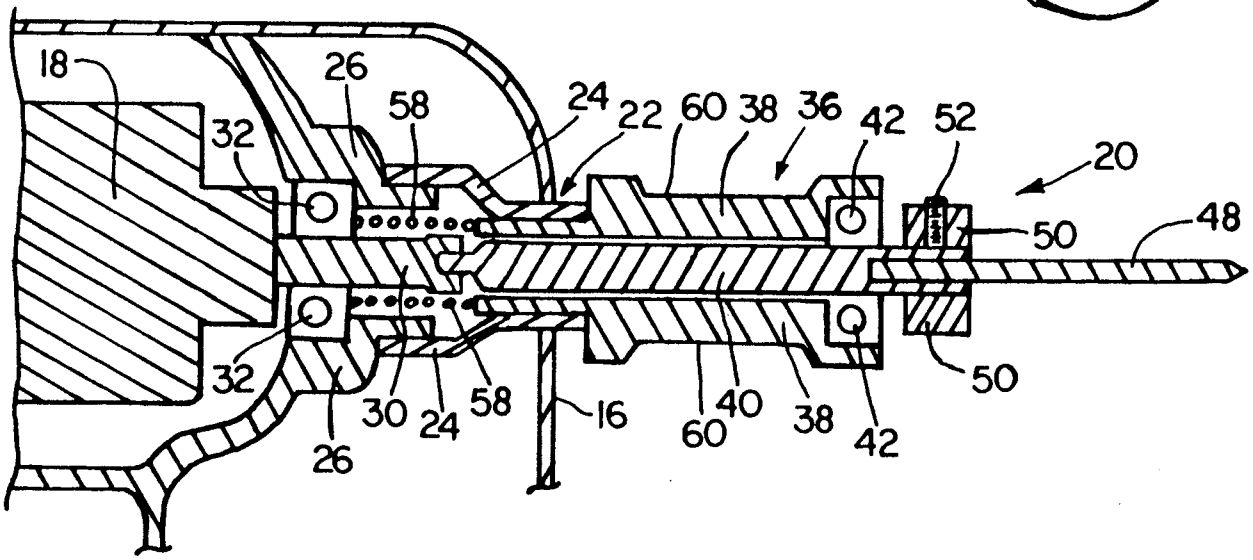
FIG. 2 is vertical cross section through the portion of the screw gun of FIG. 1 shown in the area of the broken out portion of the housing in FIG. 1.

In accordance with the present invention an easily used adapter is provided to convert the backward end 16 of the screw gun into a router or cutting tool. The improvement of the present invention comprises an access means or opening 22 through the backward end 16 of the screw gun, with the access means 22 being in alignment with a rotational axis of the drive motor 18. As shown in FIGS. 1 and 2, the access means 22 comprises a bell shaped fitting 24 that extends from the motor bearing mount 26 of the screw gun housing. The forward bell shaped portion of the fitting 24 fits in firm engagement over a cylindrical stud portion of the motor bearing mount 26, and a cylindrical extension extends from the bell shaped portion of the fitting 24 through an opening in the backward end 16 of the screw gun.

The cylindrical extension of the fitting 24 is in axial alignment with the rear end of the rear drive shaft 30 of the motor 18. The rear drive shaft 30 of the motor 18 extends through a bearing 32 positioned in the bearing mount 26 of the screw gun housing. The rear drive shaft 30 has an engageable end portion that extends rearwardly from the bearing 32 into the bell shaped portion of the fitting 24. The engageable end portion of the drive shaft 30 is accessible through the access opening formed by the cylindrical extension of the fitting 24.

A removable drive member 36 comprising a housing 38 having first and second ends is provided. The drive member 36 is capable of engagement with the cylindrical portion of the fitting 24 that forms the access means 22 by manually grasping the housing 38 and inserting the first end thereof into the cylindrical portion of the fitting 24 of the access means 22. The first end of the housing 38 is cylindrical in shape and sized to fit snugly within the cylindrical portion of the fitting 24 of the access means 22.

An elongate, rotatable extension shaft 40 having first and second ends extends longitudinally through the housing 38 of the removable drive member 36. The extension shaft 40 is supported by an appropriate bearing member 42 to freely rotate within the housing 38 about a longitudinal axis of the extension shaft 40. The first end of the extension shaft 40 is accessible at the first end of the housing 38, and the second end of the extension shaft 40 is accessible at the second end of the housing 38.

Means are provided for engaging the first end of the extension shaft 40 to the end portion of the rear drive shaft 30 when the first end of the housing 38 of the removable drive member 36 is manually inserted into the access means 22 in the backward end 16 of the screw gun. As illustrated in the drawings, the means for engaging the first end of the extension shaft 40 to the rear drive shaft 30 comprises a pair of complementary male and female engagement means formed at the first end of the extension shaft 40 and the end portion of the rear drive shaft 30, respectively.

For purposes of the present disclosure, complementary male and female engagement means is meant to include any interengageable means wherein a protuberance on one of the engageable members engages a depression in the other engageable member. As illustrated in FIGS. 1 and 2, the engagement means comprises a hex shaped socket formed in the protruding end of the rear drive shaft 30. An external hex shaped end is formed at the first end of the extension shaft 40 which fits easily but snugly within the hex shaped socket in the drive shaft 30. The distal end edge of the hex shaped end portion of the extension shaft 40 can be rounded as is well known in the art so as to facilitate the insertion of the hex shaped end portion thereof into the hex shaped socket of the rear drive shaft 30.

Means are further provided for mounting a rotatable tool, such as a routing drill bit, to the second end of the extension shaft 40. As shown in the drawings, a bore extends inwardly from the second end of the extension shaft 40 to receive the butt end of the drill bit 48. An inwardly directed, planar slit (not shown in the drawings) can be formed in the second end of the extension shaft 40, and a collar 50 having a set screw 52 can be fit around the second end of the extension shaft 40. When the set screw 52 is turned down against the second end of the extension shaft 40, the two pieces of the second end of the extension shaft 40 formed by the planar slit therein are forced toward each other and into tight engagement with the butt end of the drill bit 48.

A spring biasing system can advantageously be provided to bias the removable drive member 36 away from the rear drive shaft 30 and thus disengage the rear drive shaft 30 from the extension shaft 40 in all instances unless the removable drive member 36 is purposely and manually held in the access means 22 against the force exerted by the spring biasing system. This is a safety measure that insures that even if the adapter member of the present invention is inadvertently left in the access means when the screw gun is to be used as a conventional screw gun, the extension shaft 40 will not be engaged with the drive shaft 30 of the screw gun and therefor, the screw bit 48 of the adapter will not be rotated to otherwise possible inflict inadvertent damage to the user of the screw gun as the screw gun is being used to drive screw type fasteners into wall board panels. As shown in FIG. 2, a cylindrical spring 58 is positioned within the housing of the screw gun, with one end of the spring 58 abutting the leading end of the first end of the housing 38 of the removable drive member 36 when the first end of the housing 38 is inserted into the access means 22.

The housing 38 of the removable drive member 36 preferably has a first cylindrical portion having an inner end spaced inwardly from the first end of the housing 38. This first cylindrical portion has an external diameter that is sufficient to snugly but freely fit within the access means 22, i.e., within the cylindrical extension of the bell shaped fitting 24 of the embodiment shown in FIGS. 1 and 2 of the drawings. The housing 38 further comprises a second cylindrical portion having a first and second end, with the second cylindrical portion also having a larger outer diameter than the first cylindrical portion. The second cylindrical portion extends from the inner end of the first cylindrical portion to the second end of the housing 38, with the first end of the second cylindrical portion abutting the inner end of the first cylindrical portion forming a circular abutment ring at the inner end of the first cylindrical portion. This abutment ring forms a convenient stop for the housing 38 of the adapter member as it is inserted into the access means 22 at the rearward end 16 of the screw gun.

An annular recessed groove 60 is conveniently provided in the outer cylindrical surface of the second cylindrical portion of the housing 38 of the removable drive member 36. This groove 60 is of sufficient width to be engageable by an index finger of the user of the screw gun when the user turns the screw gun around and grasps the handle 14. By exerting his index finger in the groove 60 and pulling his index finger toward the screw gun, the user of the screw gun can hold the adapter in the access means 22 of the screw gun against the spring biasing means to engage the extension shaft 40 to the rear drive shaft 30 of the screw gun.

Figure 3:
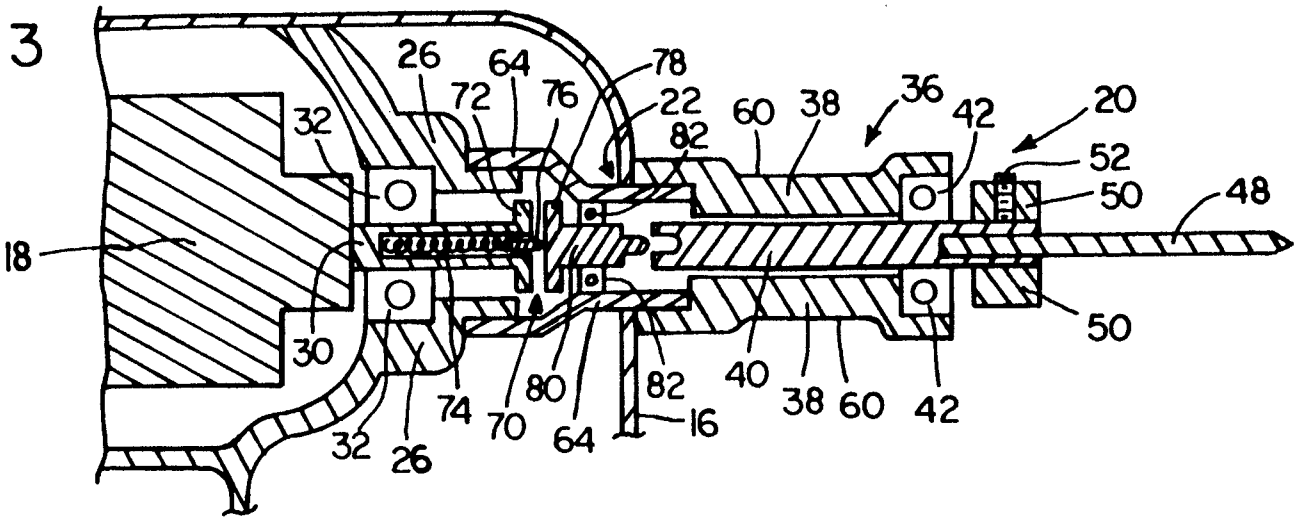
FIG. 3 is a cross section similar to that of FIG. 2 showing another embodiment of the improvements of the present invention.

A modified embodiment of an improved screw gun in accordance with the present invention is shown in FIG. 3 in which the access means 22 at the rearward end 16 of the screw gun comprises a hollow cylindrical extension member 64 that projects from the motor bearing mount 26 of the screw gun through an opening in the backward end 16 of the screw gun. A removable drive member 36 engages the end portion of extension member 64 that projects from the opening in the backward end 16 of the screw gun. In the drive member 36 as shown in FIG. 3, the first end of the housing 38 that engages the extension member 64 has an internal cylindrical surface which fits snugly over the external cylindrical surface of the projecting end of the extension member 64.

The rear drive shaft 30 of the motor 18 extends into the hollow, cylindrical extension member 64. A spring biased clutch mechanism 70 as is well known in the art is provided in combination with the end of the drive shaft 30 in the cylindrical extension member 64. As shown in FIG. 3, one disc shaped member 72 of the clutch mechanism 70 is attached directly to the projecting end of the rear drive shaft 30. A longitudinal bore is provided in the drive shaft 30 and receives a coil spring 74. A push member 76 is positioned at the distal end of the coil spring 74 and is biased by the spring 74 into contact with the corresponding disc shaped member 78 of the clutch mechanism 70.

The disc shaped members 72 and 78 have male-female type engagements that engage with each other when the disc shaped members move together in abutting contact with each other. The male-female type engagements, as explained previously, can be of any type. It is common in these type clutches to use interengaging lugs on the disc shaped members 72 and 78 or radial valleys and ridges can be provided on the disc shaped members 72 and 78 that interengage each other as the discs are brought into face-to-face contact. A shaft 80 extends through a bearing 82 that allows the shaft 80 to rotate as well as to move back and forth in a direction along the longitudinal axis of the drive shaft 30 and the shaft 80. The spring 74 normally pushes the disc 78 away from disc 72 in a direction of the bearing 82.

The distal end of the shaft 80 has means for engagement with the first end of the extension shaft 40 of the removable drive member 36. Advantageously, the distal end of the shaft 80 has an external hex shape that fits easily but snugly within a hex socket formed in the first end of the extension shaft 40 as the removable drive member 36 is engaged with the extension member 64. As the hex socket in the extension shaft 40 engages the hex shaped end of the shaft 80, the shaft 80 is pushed in a direction toward the motor 18 of the screw gun against the biasing force of the spring 74 until the clutch discs 72 and 78 engage each other. The other components of the removable drive member 36 are identical to those already discussed in reference to the removable drive member 36 shown in FIGS. 1 and 2, and these components are identified with the identical reference numerals as shown in FIGS. 1 and 2.

When manual engagement of the removable drive member 36 of the embodiment as shown in FIG. 3 is released, the spring 74 forces the clutch discs 72 and 78 apart so as to terminate rotational movement being transferred from the drive shaft 30 of the motor 18 to the extension shaft 40 and the drill bit 48 at the distal end of the extension shaft 40. This prevents inadvertent accidents from occurring wherein the user turns the screw gun around for use as a screw gun without taking the removable drive member 36 completely out of engagement with the access means 22 at the backward end 16 of the screw gun.

Another embodiment of an improved screw gun in accordance with the present invention is shown in FIG.

Figure 4:
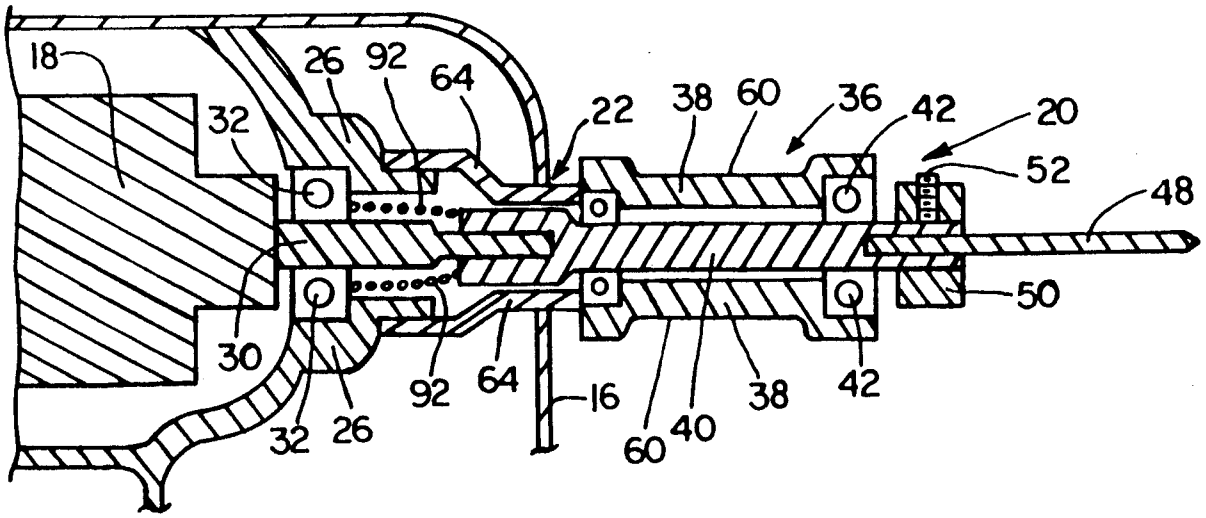
FIG. 4 is another cross section similar to that of FIG. 2 showing yet another embodiment of the improvements of the present invention.

4 in which the access means 22 at the rearward end 16 of the screw gun again comprises a hollow cylindrical extension member 64 that projects from the motor bearing mount 26 of the screw gun through an opening in the backward end 16 of the screw gun. A removable drive member 36 engages the end portion of extension member 64 that projects from the opening in the backward end 16 of the screw gun. In the drive member 36 as shown in FIG. 4, the first end of the housing 38 does not enter or fit around the extension member 64. Instead, the first end of the housing 38 simply abuts against the disal end of the extension member 64.

The rear drive shaft 30 of the motor 18 extends into the hollow, cylindrical extension member 64. The distal end of the shaft 30 has means for engagement with the first end of the extension shaft 40 of the removable drive member 36. As illustrated in FIG. 4, the distal end of the drive shaft 30 has an external hex shape that fits inside a hex socket formed in the first end of the extension shaft 40 as the removable drive member 36 is engaged with the extension member 64. The other components of the removable drive member 36, with the exception of a second bearing 90 near the socket end of the extension shaft 40, are identical to those already discussed in reference to the removable drive member 36 shown in FIGS. 1-3, and these components are identified with the identical reference numerals as shown in FIGS. 1-3. A coil spring 92 can be located in the extension member 64 to exert a biasing force against the first end of the housing 38 of the removable drive member 36. The spring 92 serves the same purpose as the springs 58 and 74 of the devices shown in FIGS. 1-3, i.e., to disengage the engagement of the drive shaft 30 from the extension shaft 40 when manual engagement of the removable drive member 36 is released.

Although preferred embodiments of improvements in a screw gun in accordance with the present invention have been illustrated and described, it is to be understood that the present disclosure is made by way of example and that various other embodiments are possible without departing from the subject matter coming within the scope of the following claims, which subject matter is regarded as the invention.

I claim:

1. In a screw gun having a forward end, a handle and a backward end, wherein a drive motor is positioned within the screw gun between the forward end and the backward end, with a screw driving head being mounted at the forward end of said screw gun to be driven by said motor, the improvement comprising an access opening through the backward end of said screw gun, said access opening being in alignment with a rotational axis of said drive motor;

an engageable end portion of a rear drive shaft extending from said drive motor, said end portion of said rear drive shaft being accessible through said access opening;

a removable adapter member comprising a housing having first and second ends, with said first end of said housing being cylindrical in shape and further being sized to slide snugly into and out of said access opening, whereby said screw gun can be essentially instantaneously converted to a hand held router by manually sliding said first end of said removable adapter member into said access opening and then manually holding said attachment member in engagement with said access opening, and further whereby said hand held router can be essentially instantaneously converted back to said screw gun by manually withdrawing said first end of said housing from said access opening;

an elongate, rotatable extension shaft having first and second ends and extending longitudinally through said housing such that the extension shaft can freely rotate within said housing about a longitudinal axis of said extension shaft, with the first end of said extension shaft being accessible at said first end of said housing and the second end of said extension shaft being accessible at said second end of said housing;

means for engaging said first end of said extension shaft to said end portion of said rear drive shaft when said first end of said housing of said removable adapter member is manually inserted in said access opening in the backward end of said screw gun; and an elongate, routing drill bit mounted to said second end of said extension shaft such that when said removable adapter member is engaged with said access means the routing drill bit extends from the backward end of said screw gun and is in axial alignment with the longitudinal axis of said extension shaft of said removable adapter member.

2. An improvement in a screw gun in accordance with claim 1 wherein the means for engaging said first end of said extension shaft to said end portion of said rear drive shaft comprises a pair of complementary male and female engagement means formed at the first end of said extension shaft and the end portion of said rear drive shaft, respectively.

3. An improvement in a screw gun in accordance with claim 2 further including a biasing means that exerts a force against said removable adapter member when the first end of said removable adapter member is manually received in said access opening, with said force being sufficient to move said removable adapter member to disengage the first end of said extension shaft from said end portion of said rear drive shaft when manual grasping of said removable adapter member is released.

4. An improvement in a screw gun in accordance with claim 1 wherein the housing of said removable adapter member comprises a first cylindrical portion having an inner end spaced inwardly from said first end of said housing, with said first cylindrical portion being received within said access opening when said first end of said housing is inserted in said access opening;

a second cylindrical portion having a first and second end, said second cylindrical portion further having a larger diameter than said first cylindrical portion, said second cylindrical portion extending from the inner end of said first cylindrical portion to the second end of said housing, with the first end of said second cylindrical portion abutting the inner end of said first cylindrical portion and forming a circular abutment ring at the inner end of said first cylindrical portion; and an annular, recessed groove in an outer cylindrical surface of said second cylindrical portion, said groove being of sufficient width to be engageable by an index finger of the user of said screw gun when the user grasps said handle of said screw gun, whereby the user can use his index finger to hold said first end of said housing fully inserted in said access opening.

5. An improvement in a screw gun in accordance with claim 4 wherein a bearing is positioned within said housing adjacent to the second end of said second cylindrical portion; and said rotatable extension shaft is received through said bearing to freely rotate within said housing.

6. In a screw gun having a forward end, a handle and a backward end, wherein a drive motor is positioned within the screw gun between the forward end and the backward end, with a screw driving head being mounted at the forward end of said screw gun to be driven by said motor, the improvement comprising a rear drive shaft extending from said drive motor;

an access opening through the backward end of said screw gun, said access opening being in axial alignment with said rear drive shaft, such that an end portion of said rear drive shaft is accessible by way of said access opening;

a removable attachment member having a first end that is cylindrical in shape and sized to slide snugly into and out of said access opening, whereby said screw gun can be essentially instanteously converted to a hand held router by manually sliding said first end of said removable attachment member into said access opening and then manually holding said attachment member in engagement with said access opening, and further whereby said hand held router can be essentially instanteously converted back to said screw gun by manually withdrawing said first end of said housing from said access opening;

a rotatable drive member associated with said attachment member, said rotatable drive member having a forward end, a distal end and a rotational axis extending between the forward end and the distal end;

means for coupling the forward end of said rotatable drive member to said end portion of the rear drive shaft of said drive motor when said removable attachment member is received in said access opening; and an elongate, routing drill bit mounted to the distal end of said rotatable drive member such that the routing drill bit has its longitudinal axis of rotation in axial alignment with said rotational axis of said rotatable drive member, whereby when said removable attachment member is received in said access opening, the elongate, routing drill bit extends away from said backward end of said screw gun and rotates in axial alignment with said rotatable drive member.

7. An improvement in a screw gun in accordance with claim 6 further including a biasing means that exerts a force against said attachment member when said attachment member is manually engaged with said access means, with said force being sufficient to move said attachment member to disengage the coupling of said rotatable drive member from said end portion of said rear drive shaft when manual engagement of said attachment member is released.

8. An improvement in a screw gun in accordance with claim 7 wherein said access means comprises a cylindrical extension member that projects from an opening in the backward end of said screw gun;

the means for coupling said rotatable drive member to said end portion of the rear drive shaft of said drive motor comprises (i) an extension shaft which has first and second ends and is rotatably mounted in said cylindrical extension member, (ii) means for engaging the extension shaft to said end portion of said rear drive shaft when the extension shaft is moved toward said end portion of said rear drive shaft and disengaging the extension shaft from said end portion of said rear drive shaft when the extension shaft is moved away from said end portion of said rear drive shaft, and (iii) means for engaging the rotatable drive member with said second end of said extension shaft when said attachment member is manually engaged with said access member; and said biasing means comprises a spring that exerts a spring force against said extension shaft to bias the extension shaft to move away from said end portion of said rear drive shaft, whereby when said attachment member is manually engaged with said access member, said engagement between the rotatable drive member and said second end of said extension shaft results in the extension shaft being pushed against said spring biasing means to thereby move toward said end portion of said rear drive shaft to engage the extension shaft to said end portion of said rear drive shaft.

* * * * *